United States Patent [19]

Braithwaite et al.

[11] 4,011,690

[45] Mar. 15, 1977

[54] PIPE CLEANING APPARATUS

[75] Inventors: John Colin Braithwaite, Newcastle; John Lawton Edwards, Ashington, both of England

[73] Assignee: British Gas Corporation, London, England

[22] Filed: Feb. 19, 1976

[21] Appl. No.: 659,357

[30] Foreign Application Priority Data

Feb. 27, 1975 United Kingdom ..... 8291/75

[52] U.S. Cl. ..... 51/8 R; 51/319

[51] Int. Cl.[2] ..... B24C 3/06; B24C 3/32

[58] Field of Search ..... 51/8 R, 9 M, 15, 241 S, 51/319–321

[56] References Cited

UNITED STATES PATENTS

| | | | |
|---|---|---|---|
| 1,910,674 | 5/1933 | Bramsen | 51/8 R |
| 2,953,876 | 9/1960 | Zieber | 51/8 R |

FOREIGN PATENTS OR APPLICATIONS

| | | | |
|---|---|---|---|
| 2,243,492 | 5/1973 | Germany | 51/241 S |

*Primary Examiner*—Gary L. Smith

*Attorney, Agent, or Firm*—Larson, Taylor and Hinds

[57] ABSTRACT

An apparatus for cleaning the surface of a pipeline by grit blasting, particularly the surface of a leaking bell and spigot joint, prior to encapsulating the joint for leak sealing purposes. The apparatus is mounted to the pipeline and has drive means to both move the apparatus around the pipeline and reciprocate the grit blasting nozzle.

4 Claims, 1 Drawing Figure

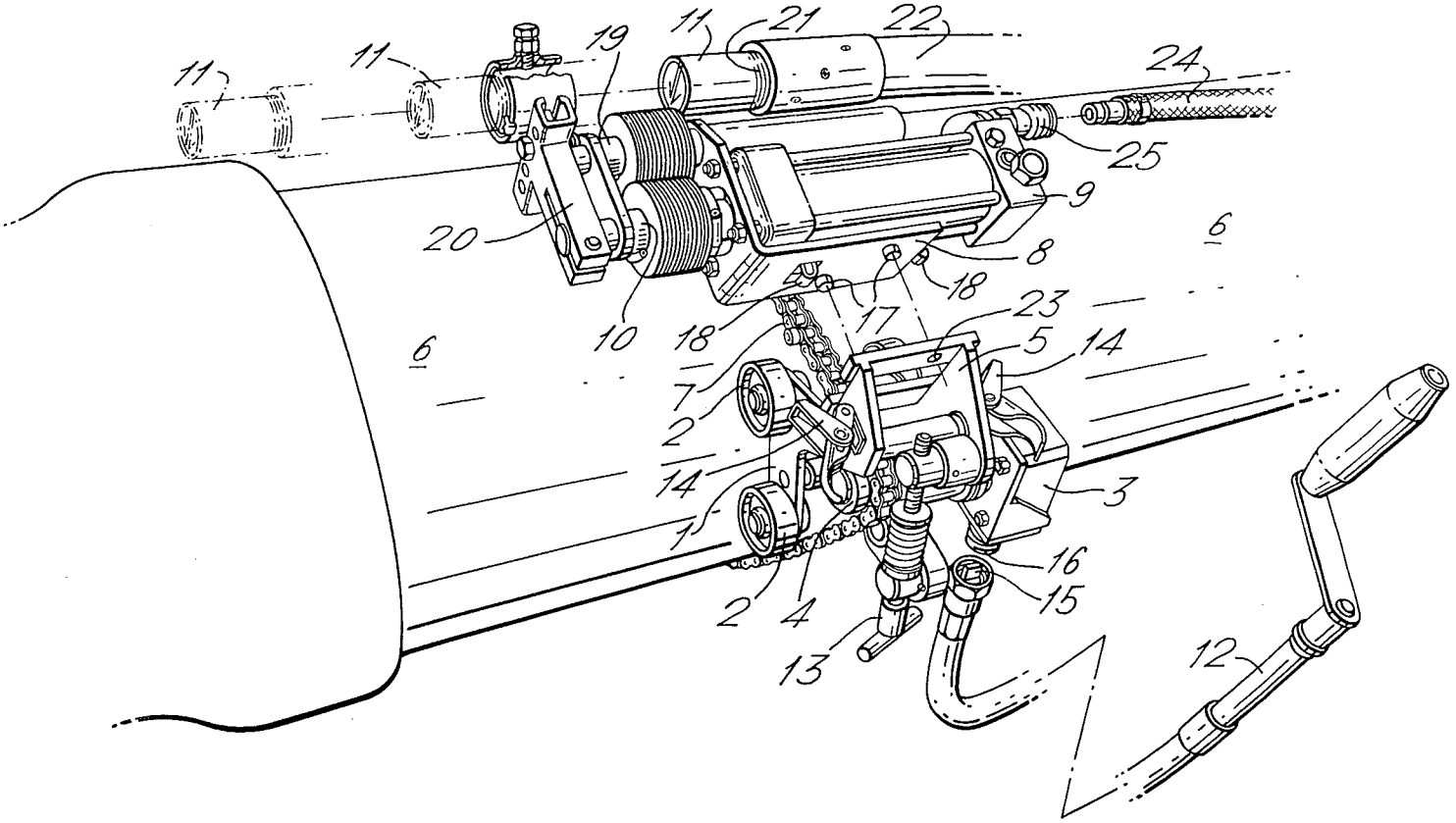
24
25
9
8
22
21
11
19
20
11
11
6
18
23
5
14
3
16
15
12
17
13
4
2
18
7
2
14
7
10
6

PIPE CLEANING APPARATUS

This invention relates to apparatus for cleaning the exterior of pipes, particularly the area surrounding bell and spigot joints on a gas main.

The method commonly used in the past for cleaning the exterior surface of the pipe around the joint area is by excavating a hole to uncover the pipe so that the complete surface of the jointed area is uncovered. To clean the pipe over the area required a grit blasting hand held nozzle is held by the operator and trained over the area to be cleaned by blasting grit forced by an air blast through the nozzle. The disadvantages of this method are as follows:

1. The grit blast operator must be in the direct vicinity of the joint and to do this he must wear special protective clothing plus an air fed helmet.

2. The under side of the joint is difficult to grit blast clean.

3. There is no control on the correct area around the circumference of the joint to be grit blasted which could result in unnecessary waste of time and effort, or inadequate cleaning.

The main reason for cleaning the jointed area such as a bell and spigot joint in a gas main, is to enable a leaking joint to be sealed by encapsulating the joint with a sealant. If the exterior jointed area is not clean this may lead to poor sealant adhesion resulting in possible leakage of the encapsulated joint. If the joint is properly grit blasted to remove corrosion etc. it provides a positive key for the sealant.

It is an object of the invention to provide an apparatus which substantially reduces the disadvantages mentioned above in cleaning pipe surfaces, by grit blasting.

According to the invention there is provided an apparatus for cleaning the surface of a pipe by grit blasting, comprising a carriage, having a drive mechanism adapted, in use, so that the carriage may be revolved around a pipe, the carriage also having a fixing plate and a tensioning device, the fixing plate adapted to detachably fix a body provided with a second driving means that, in turn, reciprocates a piston connected to a grit blasting nozzle.

It is important to have a facility to control or dwell over the area that the nozzle reciprocates and therefore it is preferable that the drive mechanism is a hand driven mechanism operating through a flexible shaft and a reduction gear box. It is therefore possible to have a forward and reversing drive.

It is preferable that the energy means to drive the reciprocating piston is compressed air.

To enable the invention to be more clearly understood and solely by way of example the invention will be described with reference to the drawings, which is a diagrammatic view of the apparatus mounted on a pipe.

The grit blasting machine according to the invention comprises a carriage 1 having wheels 2, two of which are shown. A spring loaded bell and crank lever 13 is mounted centrally on the carriage 1, a drive mechanism 3, having a final drive 4, is connected to the carriage 1, also connected to the carriage 1 is the fixing plate 5 having fixing clips 14. Located around the final drive 4 and the pipe 6 is a chain 7, a hand driven flexible drive 12 is fixed to the final drive 3 by locating a squared end 15 inside a threaded portion 16 located on the drive mechanism 3. A body 8 having studs 17 and 'U' shaped locating means 18, has an air motor 9 mounted upon it. The air motor is provided with a piston 10 and a guide means 19. Located on the end of the piston and guide means is an anchoring means 20 for locating a grit blasting nozzle 11 which has a threaded portion 21 to locate a grit carrying tube 22.

In use, the carriage 1 is mounted upon a pipeline 6 within the region of an area of the pipe that has to be cleaned, that is, over an area of the external surface of a bell and spigot joint. The carriage 1 is located upon the pipeline by an anchoring and winching chain 7 which is wrapped around the pipeline 6 and also around the final drive 4 which is a toothed wheel(not shown). The chain is joined together by a riverting means (not shown) and thus forms an endless anchoring and winching chain. The hand driven flexible drive 12 is connected to the driving mechanism 3 by screwing the square head 15 into a locating female portion, lying within the threaded end 16 of the drive mechanism 3. The carriage is tensioned onto the pipeline by using the bell and crank mechanism 13 and thus forms a carriage which can be driven around the pipeline 6. The body 8, which holds the air motor 9, is located upon the fixing plate 5 by use of the studs 17 which locate into the holes 23 on the fixing plate 5. The body 8 is held onto the fixing plate by means of the clips 14 and the 'U' shaped member 18. The air pipe 24 is connected to the air motor 9 by means of the connector 25. The grit tube 22 is connected to the grit nozzle 11 by means of screwing onto the thread 21. The air motor 9 is switched on to make sure that the reciprocating movement of the piston 10 moves the grit nozzle 11 over the required area of the external surface of the bell and spigot joint. Grit is then fed through the nozzle at a high pressure and the carriage can then be wound around the pipe by rotating the flexible hand held drive 12 which winches the carriage 1 around the pipeline (6). The nozzle continue to reciprocate across the joint thus cleaning the surface by grit blasting.

It will be understood that the apparatus described herein can be adapted to clean the inside of pipes.

The main advantage of the invented apparatus is that if a bell and spigot joint has to be cleaned prior to an encapsulation of the joint taking place, after the pipe has been exposed and the apparatus attached to the pipe, the operator can stand outside of the hole and need only wear protective goggles and not the cumbersome suit which is normally worn. If the operator is using the old method of cleaning the bell and spigot joints with the hand held grit blasting nozzle there is the possibility that the underside of the joint is not cleaned properly. A further advantage of the invented apparatus is that the external surface of the bell and spigot joint is cleaned completely.

We claim:

1. An apparatus for cleaning a surface of a pipe by grit blasting which comprises a carriage provided with a driving mechanism, a tensioning device and a fixing plate, the carriage being movably attached to the pipe by a chain which passes around the pipe and over part of a rotatable toothed cog, which cog is the final drive of the drive mechanism, and attached to the fixing plate is a body provided with an air motor which comprises means for operating a piston in a longitudinal direction along the pipe, and fixed to the piston is a grit blasting nozzle, wherein, in use, the apparatus travels around the pipe by rotating the final drive cog from the drive mechanism, whilst the nozzle reciprocates over a set longitudinal area of the pipe.

2. An apparatus according to claim 1 wherein the drive mechanism is hand operated.

3. An apparatus according to claim 1 wherein the tensioning device is a Bell and Crank assembly.

4. A method of cleaning a surface of a pipe by grit blasting using the apparatus according to claim 1, comprising the following steps, attaching the carriage to a pipe by means of a chain and tensioning the carriage by means of the tensioning device, attaching the body, including the air motor piston and grit nozzle, to the fixing plate on the carriage, applying the necessary compressed air power to the motor and grit to the nozzle, fixing the hand operated drive to the drive mechanism and rotating the apparatus around the pipe with a piston reciprocating over a set longitudinal area of the pipe.

* * * * *